US005264859A

United States Patent [19]

Lee et al.

[11] Patent Number: 5,264,859

[45] Date of Patent: Nov. 23, 1993

[54] ELECTRONICALLY SCANNED ANTENNA FOR COLLISION AVOIDANCE RADAR

[75] Inventors: Jar J. Lee, Irvine; James V. Strahan, Brea; Raymond Tang, Fullerton, all of Calif.

[73] Assignee: Hughes Aircraft Company, Los Angeles, Calif.

[21] Appl. No.: 788,080

[22] Filed: Nov. 5, 1991

[51] Int. Cl.[5] ..... H01Q 19/06

[52] U.S. Cl. ..... 343/754; 343/753; 343/909; 343/911 R

[58] Field of Search ..... 343/754, 753, 909, 787, 343/785, 768, 771, 910, 911

[56] References Cited

U.S. PATENT DOCUMENTS 4,613,869 9/1986 Ajioka et al. ..... 343/768
4,742,358 5/1988 Raber et al. ..... 34/753
4,791,427 12/1988 Raber et al. ..... 343/754

FOREIGN PATENT DOCUMENTS 2044006 10/1980 United Kingdom ..... 343/753

*Primary Examiner*—Donald T. Hajec
*Assistant Examiner*—Hoanganh Le
*Attorney, Agent, or Firm*—Wanda K. Denson-Low

[57] ABSTRACT

A millimeter wave antenna capable of electronic scanning for automobile collision avoidance radar. The antenna includes a linear ferrite loaded slot array which illuminates a dielectric lens. The antenna system has no moving parts. Beam scanning is achieved by controlling the bias magnetic field along the ferrite rod of the slot array.

11 Claims, 3 Drawing Sheets

FIG. 6
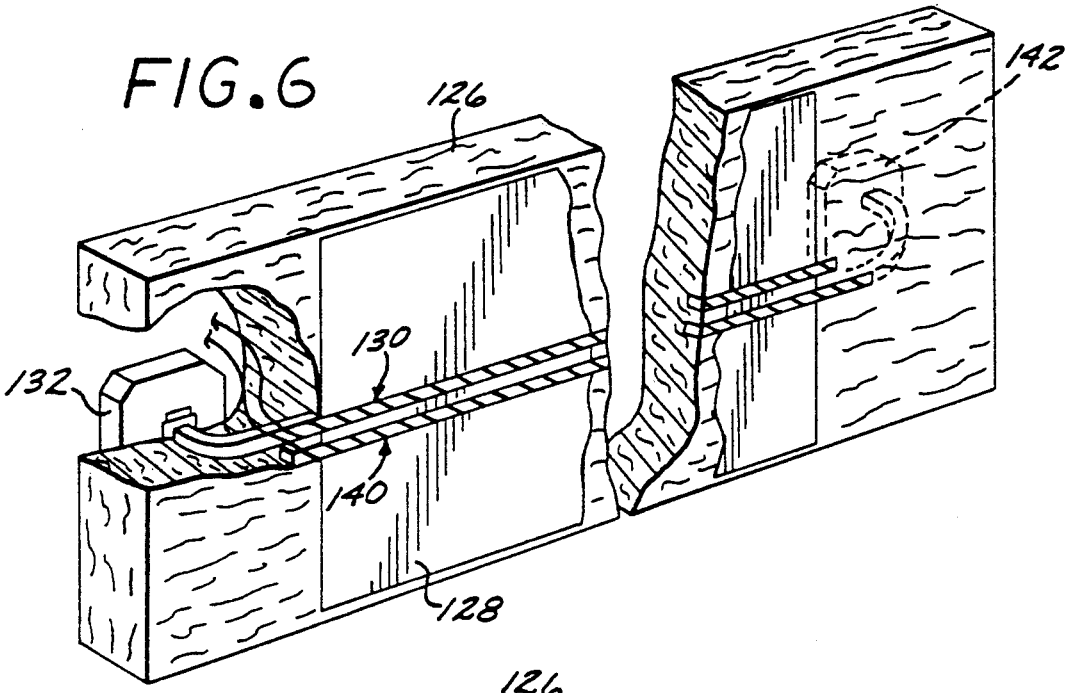
FIG. 7
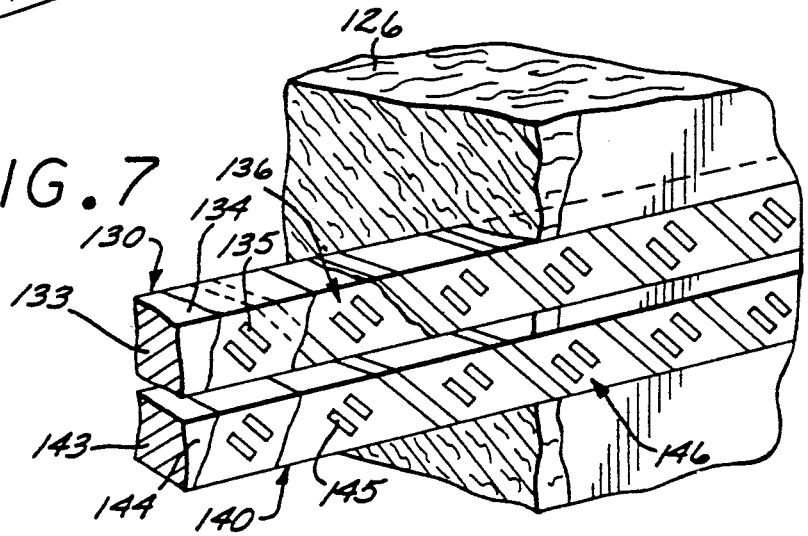
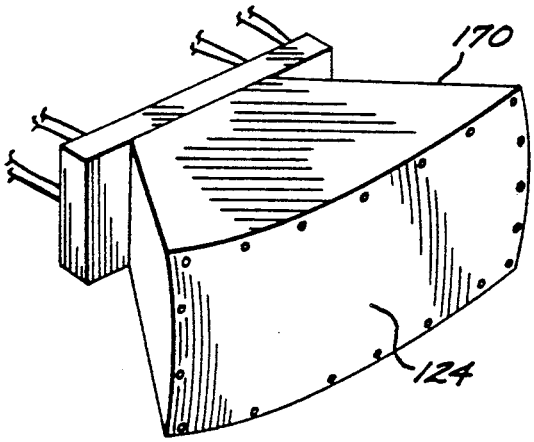
FIG. 8

ELECTRONICALLY SCANNED ANTENNA FOR COLLISION AVOIDANCE RADAR

BACKGROUND OF THE INVENTION

The present invention is a millimeter wave antenna capable of electronic scanning for automobile collision avoidance radar.

U.S. Pat. No. 4,613,869, by J. S. Ajioka and J. V. Strahan, and assigned to a common assignee with this application, describes an electronically scanned array antenna employing a ferrite loaded waveguide to support a linear slot array. The entire disclosure of this patent is incorporated herein by this reference.

Collision avoidance radar can provide functions in automotive applications. One such application is that of cruise control system radar, wherein the automotive cruise control system is controlled by the radar to slow down the vehicle when approaching another vehicle travelling the same direction. The radar may be used to disengage the cruise control when approaching a more slowly moving vehicle, or to maintain a vehicle separation distance.

It is an object of the present invention to provide an electronically scanned antenna for automotive collision avoidance radars, which has no moving parts or motor driven components, and which is reliable and relatively inexpensive.

SUMMARY OF THE INVENTION

An electronically scanned millimeter wave antenna in accordance with the invention comprises a linear ferrite loaded slot array and a feed-through dielectric lens illuminated by the slot array. The illumination beam of the slot array is electronically scanned by varying the magnetic flux through the ferrite rod. The lens comprises means for focussing the beam generated by the slot array, being curved in both the horizontal and vertical directions. The vertical cross-section of the lens is thickest in the middle to transform a divergent beam into a collimated beam with a uniform wavefront. The cross section of the lens in the horizontal direction is convex on the outside but concave on the inside surface, and is thickest at the center of the lens.

In one exemplary embodiment, two slot arrays are employed, one for transmit operations and the other for receive operations.

BRIEF DESCRIPTION OF THE DRAWING

These and other features and advantages of the present invention will become more apparent from the following detailed description of an exemplary embodiment thereof, as illustrated in the accompanying drawings, in which:

FIGS. 6–8 further illustrate the antenna embodiment of FIG. 5.

DETAILED DESCRIPTION OF THE PREFERRED EMBODIMENT

Figure 1:
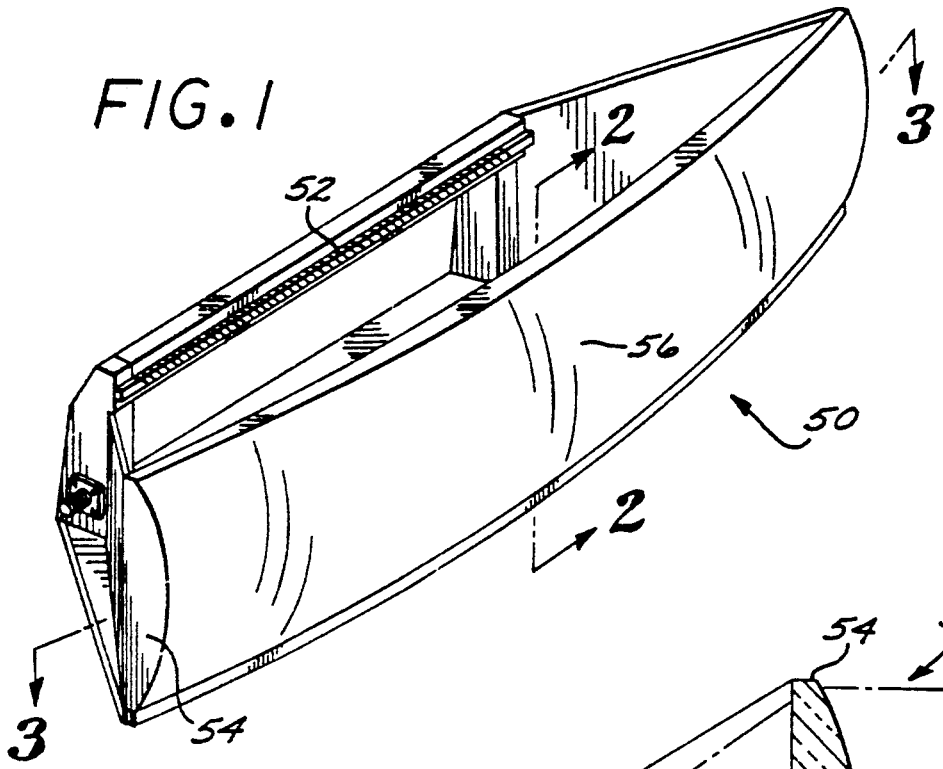
FIG. 1 is a perspective view of a millimeter wave electronically scanned antenna in accordance with the present invention.
Figure 2:
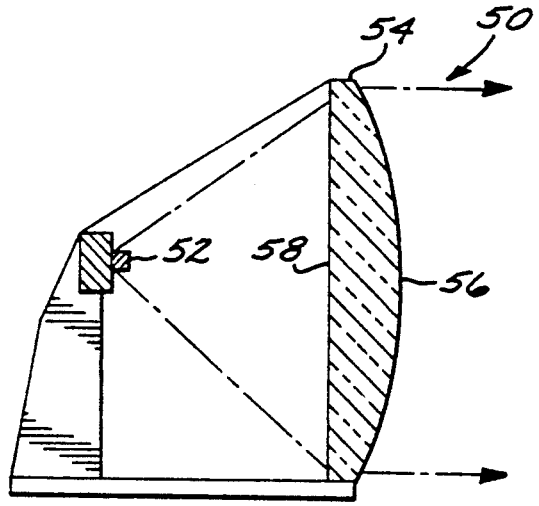
FIG. 2 is a cross-sectional view of the antenna of FIG. 1 taken along line 2—2 of FIG. 1.
Figure 3:
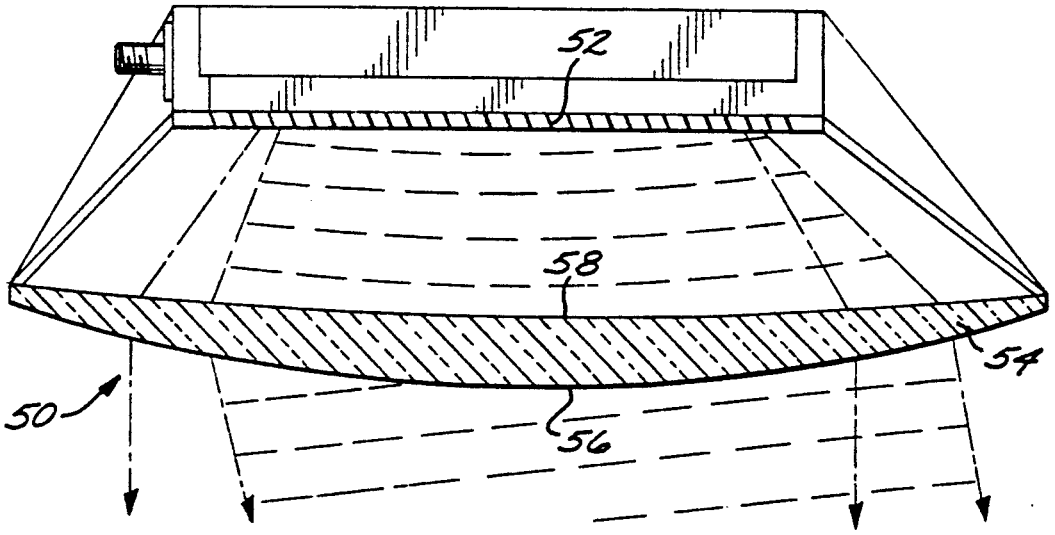
FIG. 3 is a top view of the antenna of FIG. 1.

A millimeter wave antenna 50 in accordance with the invention is shown in FIGS. 1–3. The antenna comprises a linear ferrite loaded slot array 52 which illuminates a dielectric lens 54. The antenna is electronically scannable and is, therefore, not susceptible to shocks, vibrations and the like commonly encountered on the road, which would present problems if a mechanically scanned antenna were used. Moreover, the antenna 50 does not require moving parts and the associated mechanical linkage needed for mechanical scanning. Instead, the feed horn of a mechanically scanned antenna is replaced by the stationary linear ferrite scanned array 52, and beam scanning is achieved by controlling the bias magnetic field along the ferrite rod comprising the array.

In an exemplary embodiment, the aperture size of the dielectric lens 54 is about 6 inches (vertical) and 15 inches (horizontal). The antenna of this embodiment produces a beamwidth of about 1.3° in azimuth and 2.4° in elevation plane at 60 Ghz. The linear ferrite slot array 52 in this embodiment is capable of scanning the beam in the azimuthal direction over a range of ±7°. The length of the line source may typically range from 4" to 8" depending on the focal/diameter (F/D) ratio and the thickness of the lens desired.

The lens 54 is doubly curved in the horizontal and vertical directions. The vertical cross section of the lens 54 is shown in FIG. 2. The lens 54 is thickest in the middle to transform a divergent beam from the linear array 52 into a collimated beam with a uniform wavefront. Similarly, as shown in the horizontal cross section of the lens of FIG. 3, the lens is convex on the outside surface 56 along the horizontal, but concave on the inside surface 58. It is also thickest at the center of the lens. In addition to these features, the lens 54 is designed to more or less follow a spherical contour, so that the so-called Abbe sine condition is satisfied to reduce aberrations for the azimuth scan.

The design of lenses meeting the criteria of lens 56 is described, for example, in "Antenna Handbook: Theory Application and Design," edited by Y. T. Lo and S. W. Lee, Van Nostrand, Reinhold Company, N.Y. 1988 at Chapter 16.

Figure 4:
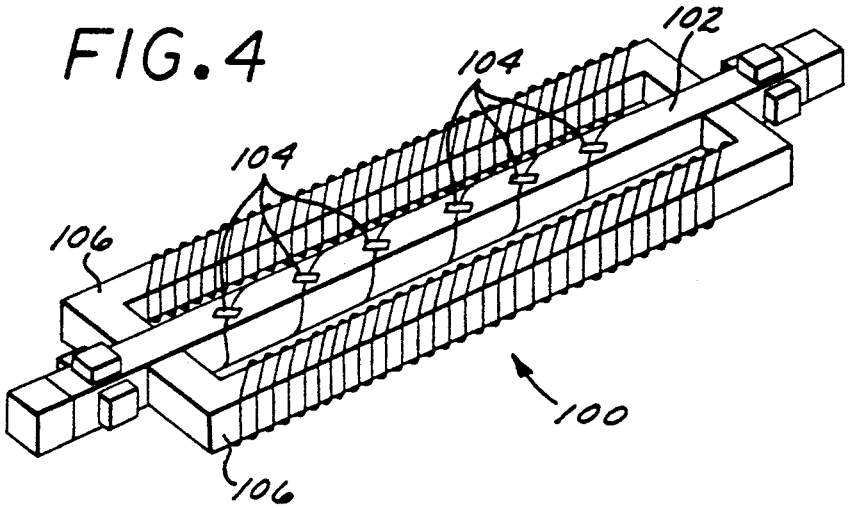
FIG. 4 is a perspective view of an array usable in an antenna configuration in accordance with the invention.

FIG. 4 illustrates an embodiment of a series-fed travelling wave slot array which may be employed in the antenna 50 This embodiment is similar to the antenna shown in FIG. 1 of U.S. Pat. No. 4,613,869. A circularly polarized wave is excited in the metallized ferrite waveguide which is magnetized along the axis. The radiating slot elements are spaced by one guide wavelength, and they are etched along one wall of the waveguide facing the lens. The slanted slots interrupt a quasi-helical surface current flowing on the inside wall of the waveguide, and couple the power out of the waveguide to form a feed pattern. The illumination beam is electronically scanned by varying the magnetic flux through the ferrite bar. This is accomplished by controlling the DC bias current wrapped around the yoke or directly around the ferrite bar.

Preferably, however, the array 52 is of the type described in pending application Ser. No. 07/708,953, filed May 31, 1991, entitled "One Piece Millimeter Wave Phase Shifter/Antenna," by W. A. Harrington et al. and assigned to a common assignee with the present application. The entire contents of this application are incorporated herein by this reference. Briefly, the antenna of this pending application replaces the ferrite yokes and drive coils of the device described in U.S. Pat. No. 4,613,869 with a plated metallic film helix, bonded to the surface of the phase shifter ferrite rod. The antenna includes a ferrite rod, on which is formed a first layer of electrically conductive material. A plurality of apertures are formed in the first conductive layer, wherein RF energy exiting the apertures forms a beam of energy. A first dielectric layer is formed over the first conductive layer. A second layer of electrically conductive material is formed over the first dielectric layer to define a helically shaped conductive region from a first end of the rod to a second end. A current drive source is connected to the ends of the helical shaped conductive region. The beam defined by electromagnetic energy radiated through the apertures may be scanned spatially by adjusting the current driven through the helical shaped conductive region.

Figure 5:
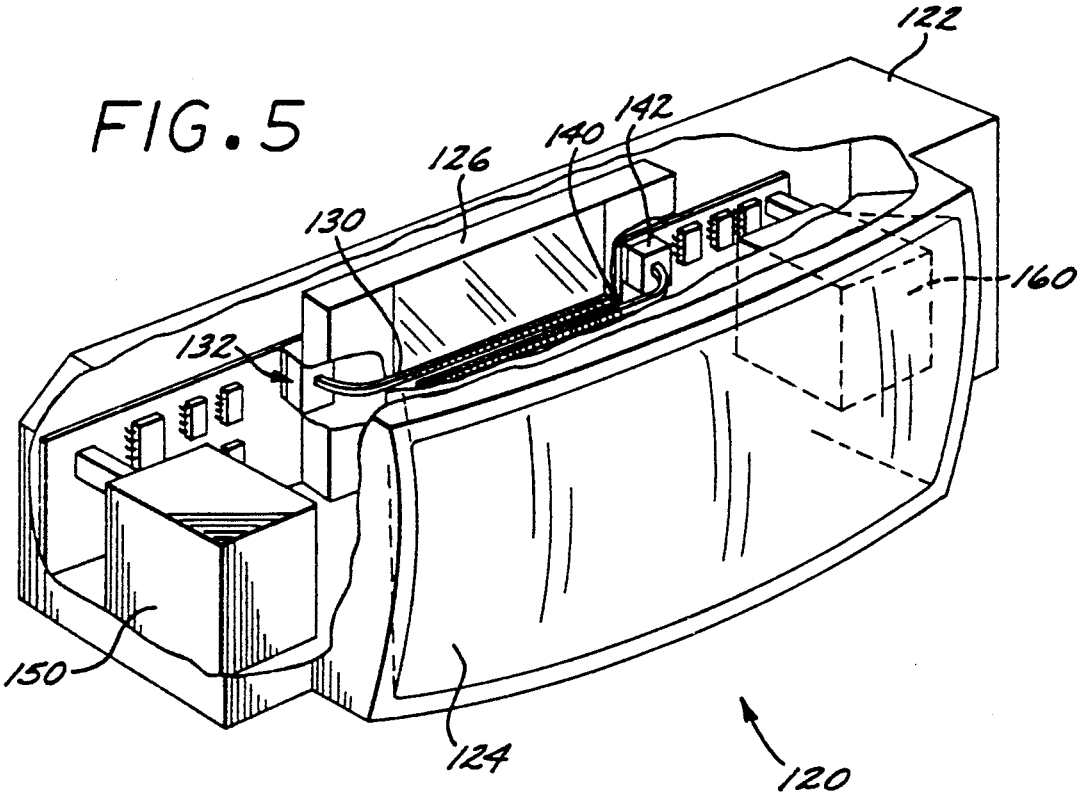
FIG. 5 is a perspective view of an alternative embodiment of an electronically scanned antenna in accordance with the invention.

FIGS. 5–8 illustrate another embodiment of an electronically scanned antenna 120 in accordance with the invention. This embodiment is particularly well suited for use in radar controlled vehicle cruise control system. FIG. 5 shows the general configuration of the array housing 122 and lens 124. The lens 124 is a feed-through dielectric lens of the type illustrated in FIGS. 1–3. This embodiment employs linear ferrite slot arrays of the type described in pending application Ser. No. 07/708,953. Further, in this embodiment, two arrays 130 and 140 are employed, one for transmit, the other for receive operations. This permits each array to be operated in a CW mode. Thus, array 130 is employed for transmit operations, and is coupled to a millimeter wave source 150 via connector 132 and other coupling circuitry not shown in FIG. 5. Array 140 is employed for receive operations, and is coupled to a radar receiver and signal processor 160 via connector 142 and other coupling circuitry not shown in FIG. 5.

FIG. 6 shows the arrangement of the arrays 130 and 140 in further detail. The arrays are mounted on a dielectric foam support 126. A metallized ground plane 128 is formed over the support 126 behind the active areas of the arrays 130 and 140.

While the construction of each array 130 and 140 is described more fully in pending application Ser. No. 07/708,953, FIG. 7 shows the arrangement of the two arrays 130 and 140 in some detail. The arrays respectively comprise ferrite rods 133 and 143, coated with respective conductive layers 134 and 144. Inclined slots 135 and 145 are formed in the respective layers 134 and 144. Dielectric layers cover the conductive layers 134 and 144. A second conductive layer is formed over each dielectric layer, and helical grooves 136 and 146 are cut into the second conductive layers. The bias current is applied to the respective ends of the second conductive layer, the helical groove serving to define a path for current analogous to the coils of the embodiment of FIG. 4.

Typically, the arrays 130, 140 will have a length about one half the aperture size. The arrays can be made longer or shorter, but at the cost of greater expense for the arrays and lens if made longer, and greater expense and complexity of the lens if made shorter.

To avoid crosstalk between the two arrays 130 and 140, they are spaced apart by about one half to one wavelength at the middle frequency of operation. A metal barrier could be placed between the two arrays to further reduce the crosstalk. Both arrays are placed at the focal point of the lens 124.

The lens 124 is preferably fabricated from a material having a relatively low dielectric constant, in the range of 2 to 3. The lens may be fabricated from dielectric materials commercially available under the trademarks "Rexolite" or "Teflon" from E. I. du Pont de Nemours & Co. The lens could be made of quartz, but at significant increase in expense.

FIG. 8 shows the antenna 170 for the array of FIG. 5, the structure 170 fitting inside the housing 122 of FIG. 5.

The antenna array of FIGS. 5–8 does not provide the capability of electronic scannability in elevation. If such capability is needed for a particular application, a two-dimensional array could be provided although this would add to the expense.

The present invention provides a low cost millimeter wave electronically scanned antenna, suitable for use in such applications as vehicle cruise control radars. Advantages include:

1. The invention provides electronic scan capabilities to allow more powerful and flexible processing algorithms to be used, instead of a mechanical gimbal system which is restricted by the slow scan rate, a limitation on the radar operation.

2. The new radar antenna has no moving parts or motor driven components, thus enhancing the system reliability.

3. The antenna has fewer components and is therefore less expensive to manufacture.

4. The antenna employs a feed-through lens, instead of a reflector, the lens serving as a radome and part of the enclosure as in a headlight configuration. This form factor is better than a reflector and is more compatible with a vehicle environment.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A millimeter wave antenna which may be electronically scanned, comprising:

a linear ferrite loaded slot array; and a feed-through dielectric lens illuminated by said slot array, said lens comprising means for focusing the beam generated by said slot array, said lens being doubly curved in both the horizontal and vertical directions, the vertical cross-section thereof being thickest in the middle to transform a divergent beam into a collimated beam with a uniform wavefront, the cross section of the lens in the horizontal direction being convex on the outside but concave on the inside surface, and being thickest at the center of the lens.

2. The antenna of claim 1 further comprising means for varying the magnetic flux through said ferrite load, wherein the illumination beam of said slot array is electronically scanned in the azimuthal direction.

3. The antenna of claim 1 wherein said lens further serves the function of a radome for said antenna.

4. The antenna of claim 1 wherein said slot array comprises a ferrite loaded waveguide.

5. An electrically scanned millimeter wave antenna system, comprising:

first and second linear ferrite loaded slot arrays, said first array for transmit operation, said second array for receive operation;

a feed-through dielectric lens illuminated by said slot arrays, said lens comprising means for focussing the beam generated by said first slot array and for focussing received energy on said second slot array, said lens being curved in both the horizontal and vertical directions, the vertical cross-section thereof being thickest in the middle to transform a divergent beam into a collimated beam with a uniform wavefront, the cross-section of the lens in the horizontal direction being convex on the outside but concave on the inside surface, and being thickest at the center of the lens; and wherein said first and second slot arrays are located at least near the focal point of said lens, and further comprising means for varying the magnetic flux through said ferrite load of said first slot array, wherein the illumination of said first slot array is electronically scannable in the azimuthal direction, and means for varying the magnetic flux through said ferrite load of said second slot array, wherein the receive beam of said second slot array is electronically scannable in the azimuthal direction.

6. The antenna system of claim 5 wherein each of said slot arrays comprises a ferrite loaded waveguide.

7. The antenna system of claim 5 wherein said first and second slot arrays are disposed in parallel alignment and separated by at least one half a wavelength at the center frequency of operation to reduce crosstalk between said arrays.

8. The antenna system of claim 5 wherein said lens further serves the function of a radome for said antenna system.

9. The antenna system of claim 5 wherein said slot arrays are electronically scannable only in the azimuthal direction.

10. The antenna system of claim 5 wherein said first and second linear ferrite loaded slot arrays each comprise: a ferrite rod coated with a conductive layer, said conductive layer having slots formed therein, a dielectric layer covering said slots and conductive layer, and a helical coil wound about said ferrite rod such that two slots are located between successive turns of said coil.

11. The antenna of claim 10 wherein said helical coil comprises a second conductive layer formed over the dielectric layer and having a helical groove cut therein and having cuts therein to expose said slots.

* * * * *